United States Patent [19]

Herou

[11] 4,163,127

[45] Jul. 31, 1979

[54] POSITION SENSITIVE SAFETY SWITCH

[75] Inventor: John W. Herou, Milaca, Minn.

[73] Assignee: J. H. Electric Co., Inc., Princeton, Minn.

[21] Appl. No.: 868,701

[22] Filed: Jan. 11, 1978

[51] Int. Cl.[2] ..... H01H 35/00

[52] U.S. Cl. ..... 200/61.47; 200/302

[58] Field of Search ..... 200/61.45 R, 61.47, 200/61.52, 293, 302, 61.2, 187, 215-219, 220, 224

[56] References Cited

U.S. PATENT DOCUMENTS

| | | | |
|---|---|---|---|
| 2,116,075 | 5/1938 | Lenhart | 200/61.21 |
| 2,713,159 | 7/1955 | Morrison | 200/61.52 X |
| 3,228,019 | 1/1966 | Visceglia | 200/61.47 X |
| 3,236,989 | 2/1966 | Zavertnik et al. | 200/302 X |
| 3,869,588 | 3/1975 | Ubukata et al. | 200/61.47 |
| 3,941,956 | 3/1976 | Delin et al. | 200/61.21 X |

FOREIGN PATENT DOCUMENTS

| | | | |
|---|---|---|---|
| 101145 | 4/1925 | Fed. Rep. of Germany | 200/61.47 |

*Primary Examiner*—James R. Scott

*Attorney, Agent, or Firm*—Orrin M. Haugen; Thomas J. Nikolai

[57] ABSTRACT

An arc free electrical switch assembly for use in highly combustible environments which includes a hollow chamber defined by integrally formed bottom, side and end walls in which is disposed a switch mounting bracket having a pair of mercury switches mounted thereon with their respective contacts connected in a series string and so oriented that when the housing is in a predetermined orientation, both of said switches are electrically closed, but when the housing is rotated with respect to a working surface in a first direction or a second opposite direction, one or the other of said pair of switches open to break the series string. A cover plate and a sealed conductor lead-in are also included as a part of the housing such that grain dust or other combustible substances present cannot be exposed to an electrical spark or arc in the event that the assembly is inadvertently connected to a higher than normal voltage source. The switch assembly is readily adapted for use as a jam detector for a conveyor belt system.

3 Claims, 3 Drawing Figures

Fig. 1
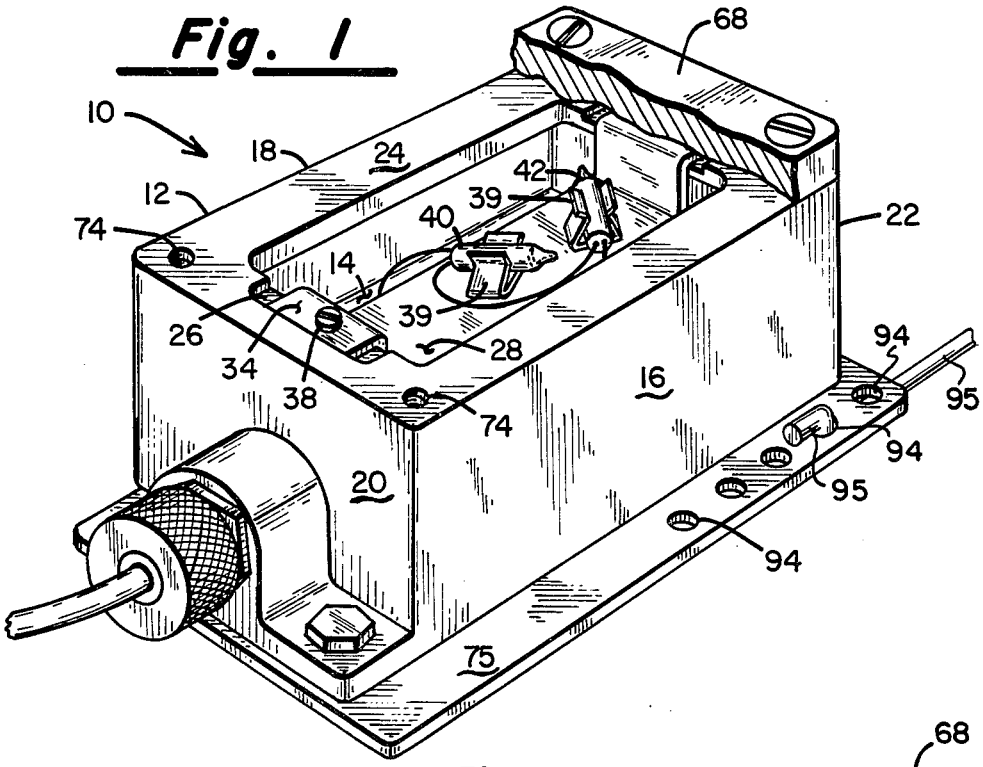
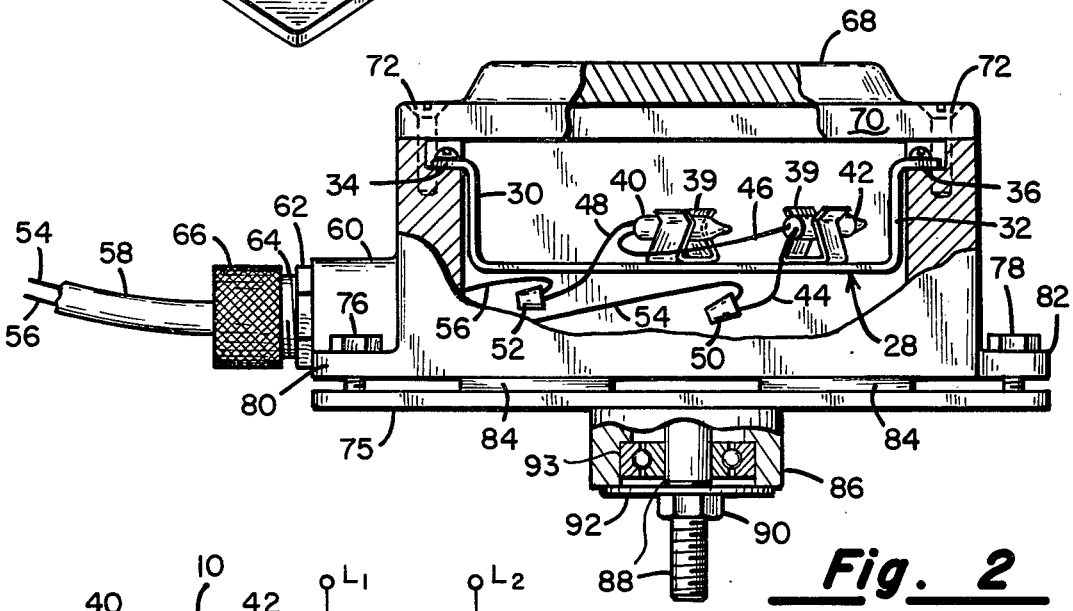
Fig. 2
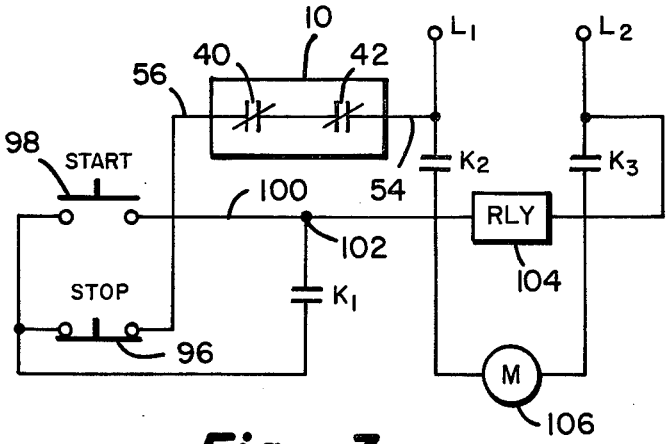
Fig. 3

POSITION SENSITIVE SAFETY SWITCH

BACKGROUND OF THE INVENTION

I. Field of the Invention

This invention relates generally to electrical safety switches, and more specifically to the design of a position sensitive switch assembly which is specifically constructed for use in environments where any electrical arc or spark cannot be tolerated.

II. Description of the Prior Art

There are a wide variety of applications for a switch arrangement of the type to be described herein. For example, in grain storage and handling applications, it is often times convenient to use conveyor belt systems for transporting loose grain. However, because the dust particles emanating from dried grain mix with air, the mixture is potentially highly explosive and combustible.

Conveyor systems also generally utilize devices for detecting an overload or jam condition. For example, there is disclosed in the Schlagel U.S. Pat. No. 3,952,864 an arrangement utilizing a low-travel Microswitch-type mechanical switch cooperating with a cam which is effective to sense the travel of a conveyor pulley which occurs during an overload or jam situation. The switch is electrically connected in circuit with the conveyor drive motor so that when the switch toggles, power is removed from the motor.

While this arrangement may be altogether suitable for use with conveyor systems in environments where there is no concern over explosion, in those applications where such a risk is high, it is totally unsuitable because of the possibility of the generation of an electrical arc or spark in an overload situation.

The Schmeck et al U.S. Pat. No. 3,066,789 also discloses a jam detector for a conveyor belt system in which mercury-type switches are employed to sense the relative position of a conveyor drive or idler pulley. In the Schmeck arrangement, the mercury switches are mounted in a tipped orientation so that their contacts are normally open. A sudden translation of the conveyor pulley occasioned by a jam will cause one or the other of the switches to become closed and this action results in a de-energization of the conveyor drive motors.

SUMMARY OF THE INVENTION

The preferred embodiment of the present invention is deemed to be an improvement over the position sensitive switch arrangements disclosed in the aforereferenced Schlagel and Schmeck et al Patents. The present invention provides a unitary assembly of a housing containing switching means which may safely be used in highly combustible atmospheres without the fear of inducing an explosion in the event of accidental breakage of the switching devices themselves or due to the mistaken or erroneous connection of the electrical circuitry to an excessively high voltage source.

The preferred embodiment of the present invention includes a hollow chamber defined by integrally formed bottom, side and end walls in which is disposed a switch mounting bracket having first and second mercury switches mounted thereon with their respective contacts connected in a series string. The mercury switches are oriented on the bracket so that when the housing is in a predetermined position, both of the switches are electrically closed. However, when the housing is rotated with respect to a working surface on which it is mounted in either a first direction or a second opposite direction, one or the other of the pair of switches open to break the series string. The preferred embodiment also includes a cover plate and a sealed conductor lead-in to totally and effectively isolate the electrical circuitry of the switches from the ambient.

A further feature of the preferred embodiment is the inclusion of a mounting plate and an associated axle and bearing assembly which permits the device to be conveniently mounted and which isolates the mercury switches from substantial shock and vibration which might otherwise result in the inadvertent opening of the normally closed series string.

These and other features and advantages of the invention will become apparent to those skilled in the art from the following detailed description of the preferred embodiment, especially when considered in light of the accompanying drawings in which like numbers in the several views refer to corresponding parts.

BRIEF DESCRIPTION OF THE DRAWINGS

FIG. 1 is a perspective view with the cover plate partially broken away to show the internal construction of the preferred embodiment;

FIG. 2 is a side elevation with a portion of a side wall broken away to illustrate the relative orientation of the switch elements; and FIG. 3 is a circuit schematic diagram illustrating the manner in which the preferred embodiment may be utilized in a motor control application.

DESCRIPTION OF THE PREFERRED EMBODIMENT

Referring first to FIG. 1, there is indicated generally by numeral 10 the position sensitive safety switch of the present invention. The device comprises a housing 12 which is preferably cast from a suitable metal so as to include a bottom wall 14 having integrally formed side walls 16 and 18 along with end walls 20 and 22. The side and end walls each terminate in a common plane defining a top surface 24. Furthermore, the side and end walls are spaced apart and parallel to one another so as to define a generally rectangular enclosed volume.

Formed in the top surface 24, proximate the end walls 20 and 22 are trapezoidal shaped recesses which extend downwardly a predetermined distance from the top surface 24. Spanning the space between the opposed end walls 20 and 22 is a generally "U"-shaped bracket having opposed parallel legs 30 and 32 extending perpendicularly from the center portion thereof and terminating in integrally formed, outwardly extending flanges 34 and 36. These flanges 34 and 36 abut the top surface of the recessed areas 26 and are secured thereto by means of screws 38. Thus, the bottom portion of the "U"-shaped bracket 28 is generally parallelly disposed with respect to the bottom member 14, but is spaced apart therefrom.

Attached to the center portion of the bracket 28 are first and second spring metal clamps 39 for receiving and holding first and second mercury-type switches 40 and 42. The mercury switches are conventional in their construction and include a sealed glass enclosure in which is disposed first and second spaced apart contact elements and a quantity of mercury. Depending upon the orientation of the switch elements, the mercury pool either bridges the two spaced apart contacts or is separated therefrom by a predetermined distance. Thus, the switch is electrically closed or opened, depending upon the location of the mercury pool within its glass container.

With reference to FIG. 1, it can be seen that the longitudinal axis of the mercury switch 40 is disposed at an angle with respect to the corresponding axis of the mercury switch 42. Thus, when the assembly is oriented 90° from the position illustrated in FIG. 2 with the end wall 20 horizontally disposed below end wall 22, the mercury pools in each of the switches 40 and 42 will encompass the respective spaced apart contacts so that the switches are electrically closed. Also, as can be seen from FIG. 2, the contacts of the switches 40 and 42 are connected in series arrangement by way of the conductors 44, 46 and 48. The conductors 44 and 48 are joined in a suitable connector 50 and 52 to individual conductors 54 and 56 in the insulated electrical cord 58.

The electrical cord 58 and its included conductors 54 and 56 enter the housing by way of a cylindrical collar 60 which has a concentric bore formed therethrough which leads into the enclosed volume. The bore in the collar 60 is internally threaded to accept a screw-in fitting 62 which has an externally threaded stem 64 onto which a knurled ring 66 may be screwed. In order to effect a tight seal, a rubber plug or grommet may be disposed about the insulated cord 58 and inserted into the fitting 64 such that when the ring cap 66 is screwed in place, a tight seal is established between the cord and its entrance aperture.

As is illustrated in FIGS. 1 and 2, completing the sealed enclosure is a top plate 68 having a generally rectangular base portion 70 of the same dimension as the generally rectangular top surface 24 of the housing. The cover plate 68 is adapted to be held in place by means of fasteners such as screws 72 which pass through countersunk holes formed in the top plate and into threaded apertures 74 formed in the top surface 24 of the housing. When the cover is bolted in place, a totally sealed enclosure is provided for the mercury switch elements 40 and 42, especially when the nature of the sealed lead-in assembly previously described is considered.

Again with reference to FIG. 2, it can be seen that the position sensitive safety switch 10 further includes a mounting plate 75 which is coupled to the bottom member 14 of the housing by way of bolts 76 and 78 which pass through oversized apertures formed in the outwardly extending flanges 80 and 82 which are an integral part of the casting which defines the housing. In order to reduce the effects of shock and vibration on the switch elements 40 and 42, resilient pads such as rubber pads 84 are disposed between the outside surface of the bottom member 14 and the surface of the mounting plate 74.

Extending outwardly from the mounting plate 74 in a direction opposite to that from which the switch housing assembly extends in a generally cylindrical projection 86 which has a concentric bore formed therein into which is fitted a ball bearing set (not shown) for rotationally supporting a mounting axle 88. The axle 88 is threaded to accept a nut 90 and a washer 92 serves to shield the ball bearings from dirt, dust and other contamination.

This completes a description of the construction of the preferred embodiment. Next to be considered is its mode of operation.

OPERATION

The position sensitive safety switch 10 of the present invention is adapted to be mounted in a generally vertical orientation with the lead-in assembly 60–66 directed downward. The device is attached to a working surface by inserting the mounting axle 88 through a suitable bore on that working surface and then fastening it in place by means of a nut which is also threaded on the axle 88. Because the axle 88 is journaled for rotation in the ball bearing housing 86, the unit is free to rotate about the axle 88 as a pivot.

Because of the manner in which the mercury switches 40 and 42 are disposed on the mounting bracket 28 when the device is oriented in the manner indicated above, the mercury pools of these switches will be generally disposed toward the base of the switch and will electrically couple the spaced apart contacts of the switch together. However, if an outside force applied to the assembly should cause the assembly to rotate about the axle 88 by a predetermined circumferential distance or angle, the mercury pool in one or the other of the switches 40 or 42 will flow away from its associated contacts and will open the series circuit. The particular switch 40 or 42 to open will depend upon the direction of rotation of the housing with respect to the working surface on which it is mounted.

When utilizing the invention as a jam detector for a conveyor system, the threaded axle 88 may be attached to a conveyor frame member and a rod or linkage 95 may be coupled to one of the holes 94 formed in the mounting plate 74. The other end of the linkage may be attached to the drive or idler pulley of the conveyor (not shown) such that if a jam occurs in an upper or lower span of the conveyor belt, translational motion of the pulley will be imparted to the mounting plate, thereby imparting rotation to the position sensitive switch 10. By providing a plurality of mounting holes 94 of a different distance from the axis of rotation, it is possible to conveniently adjust the system to sense different degrees of overload or jamming of the conveyor system.

The circuit diagram of FIG. 3 illustrates the manner in which the position sensitive switch 10 may be used in a motor control application to cause the motor to be disconnected from the lines in the event of a malfunction. The terminals $L_1$ and $L_2$ are adapted to be connected to a source of potential such as 110 volt, 60 Hz supply. The position sensitive switch 10 and specifically the mercury switches 40 and 42 are connected in series between the terminal $L_1$ and a contact of a normally closed STOP push button switch 96. A normally opened START push button switch 98 is also provided and has one terminal thereof connected in common to a second terminal of the aforementioned STOP switch. The second terminal of the START switch 98 is connected by a conductor 100 to a first terminal 102 of a relay 104. The relay serves to operate three normally opened contacts labeled $K_1$, $K_2$ and $K_3$. The normally opened contacts $K_1$ are connected between the relay terminal 102 and the terminal of the STOP switch 96. The relay contacts $K_2$ and $K_3$ are connected in series with the lines leading from the supply terminals $L_1$ and $L_2$ to the motor 106.

Under normal operation, when the START button 98 is depressed, a current flows from terminal $L_1$ through the closed switches 40 and 42 of the position sensitive switch 10 and through conductor 56, the closed STOP switch 96 and through the conductor 100 and the relay coil 104 to the other supply terminal $L_2$. The relay 104 is thereby energized causing the contacts $K_1$, $K_2$ and $K_3$ to close. When contact $K_1$ closes, it latches up the START switch 98 so that it may now return to its normally open position without breaking the circuit to the relay 104. With contacts $K_2$ and $K_3$ closed, the motor 106 will be energized.

Should an abnormal situation arise which serves to cause rotation of the position sensitive switch 10, one or the other of the series connected contacts 40 or 42 will open, thereby breaking the circuit through the relay coil 104 such that the contacts $K_1$, $K_2$ and $K_3$ again reopen. With the contacts $K_2$ and $K_3$ open, the motor 106 is no longer energized and the working system is brought to a stop.

Since many changes could be made in the embodiment of the invention particularly described and shown herein without departing from the scope of the invention, it is intended that the embodiment be considered as exemplary and that the invention not be limited, except as warranted by the following claims.

What is claimed is:

1. A safety switch for use in a combustible environment, comprising:

(a) a box-like housing having a pair of end walls separated from one another by an integrally formed, spaced apart pair of side walls and having a bottom member bonded to a first edge surface of said side and end walls;

(b) a support bracket attached between said pair of end walls and wholly contained within said housing;

(c) first and second mercury-type switches each having spaced apart contacts and a pool of mercury enclosed in a sealed container, said switches being attached to said support bracket and having the longitudinal axes of their containers disposed along intersecting lines such that when said housing is mounted in a predetermined orientation said pool of mercury in each of said sealed containers electrically closed its associated contacts;

(d) a cover plate adapted to be attached to second edge surfaces of said pairs of side and end walls;

(e) a plate having first and second planar surfaces;

(f) resilient spacer means disposed on said first planar surface;

(g) a cylindrical tubular member disposed on said second planar surface and extending outwardly therefrom;

(h) an axle journaled for rotation within said cylindrical tubular member; and (i) means for coupling said plate to said bottom member with said resilient spacer means abutting the outer surface of said bottom member, the arrangement being such that rotation of said housing about said axle by a predetermined angle in a first direction from said predetermined orientation causes the mercury pool in said first switch to electrically open its associated contacts and rotation of said housing about said axle by a predetermined angle in a second direction from said predetermined causes the mercury pool in said second switch to electrically open its associated contacts.

2. Apparatus as in claim 1 wherein said spaced apart contacts of said first and second mercury-type switches are electrically connected in a series arrangement.

3. Apparatus as in claim 2 and further including:

(a) a cylindrical collar integrally formed in one of said side or end walls having a concentric bore extending therethrough into said box-like housing;

(b) first and second elongated wire conductors extending through said bore and connected to said series arrangement of contacts; and (c) means surrounding said wires and insertable in said bore for sealing said bore from the ambient.

* * * * *

UNITED STATES PATENT AND TRADEMARK OFFICE

CERTIFICATE OF CORRECTION

PATENT NO. : 4,163,127

DATED : July 31, 1979

INVENTOR(S) : John W. Herou

It is certified that error appears in the above-identified patent and that said Letters Patent are hereby corrected as shown below:

Column 6, line 3, Claim 1, "closed" should read -- closes --.

Column 6, line 23, Claim 1, before the word "causes" insert -- orientation --.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*